United States Patent [19]

Prestridge

[11] Patent Number: 5,065,531

[45] Date of Patent: Nov. 19, 1991

[54] ATTACHMENT DEVICE FOR PROVIDING DETACHABLE UPPERS IN FOOTWEAR AND THE LIKE

[76] Inventor: Patrick L. Prestridge, 5101 McLarnan Rd., Gambier, Ohio 43022

[21] Appl. No.: 569,988

[22] Filed: Aug. 20, 1990

[51] Int. Cl.[5] ..... A43B 3/24; A43B 13/28

[52] U.S. Cl. ..... 36/100; 36/101; 36/1; 36/12; 36/15

[58] Field of Search ..... 36/1, 12, 15, 100, 101

[56] References Cited

U.S. PATENT DOCUMENTS

| | | | |
|---|---|---|---|
| 1,803,554 | 5/1931 | Knilans | 36/12 |
| 2,302,596 | 11/1942 | Bigio | 36/12 |
| 2,438,711 | 3/1948 | Leach et al. | 36/12 |
| 2,444,640 | 7/1948 | Epstein | 36/12 |
| 2,519,108 | 8/1950 | Bryant et al. | 36/101 |
| 2,552,943 | 5/1951 | Danielius | 36/15 |
| 2,761,224 | 9/1956 | Gardiner | 36/101 |
| 3,204,346 | 9/1965 | Lockard et al. | 36/15 |
| 3,436,844 | 4/1969 | Sachs | 36/101 |
| 3,878,626 | 4/1976 | Isman | 36/15 |
| 4,062,132 | 12/1977 | Klimaszewski | 36/100 |
| 4,103,440 | 8/1978 | Lawrence | 36/101 |
| 4,267,649 | 5/1981 | Smith | 36/101 |
| 4,267,650 | 5/1981 | Bauer | 36/101 |
| 4,317,294 | 3/1982 | Goodyear | 36/100 |
| 4,363,177 | 12/1982 | Boros | 36/101 |
| 4,377,042 | 3/1983 | Bauer | 36/101 |
| 4,439,935 | 4/1984 | Kelly | 36/101 |
| 4,606,139 | 8/1986 | Silver | 36/15 |
| 4,628,622 | 12/1986 | McBarron | 36/50 |
| 4,706,392 | 11/1987 | Yang | 36/100 |
| 4,745,693 | 5/1988 | Brown | 36/101 |
| 4,805,321 | 2/1989 | Tonkel | 36/100 |
| 4,839,948 | 6/1989 | Boros | 24/662 |

FOREIGN PATENT DOCUMENTS

| | | | |
|---|---|---|---|
| 1685 | 11/1916 | Netherlands | 36/100 |
| 599 | of 1861 | United Kingdom | 36/100 |

OTHER PUBLICATIONS

Computer Abstracts of Patents.

*Primary Examiner*—Paul T. Sewell
*Assistant Examiner*—M. Denise Patterson
*Attorney, Agent, or Firm*—Ware, Fressola, Van der Sluys & Adolphson

[57] ABSTRACT

A shoe having an upper portion and a sole-and-toe portion which portions are releasably joined together by a male/female track attachment device. The female track is attached to the upper and extends the entire length of the bottom portion of upper. The male track is attached to the sole and is embedded in the sole wall assembly. The bead of the male track is elevated above the sole wall in position to receive the female track. The male track begins at the toe, extends around the heel and terminates at the toe. The upper is connected to the sole by threading the female track through the male track, around the heel until the ends of female track align with the ends of male track.

22 Claims, 3 Drawing Sheets

10B
68
57B
12B
16B
74

16
11
56
76

70

72

ATTACHMENT DEVICE FOR PROVIDING DETACHABLE UPPERS IN FOOTWEAR AND THE LIKE

BACKGROUND OF THE INVENTION

The present invention relates to footwear and the like, and more particularly to footwear having-an upper portion thereof adapted to be detachable from the sole.

Recently, it has become increasingly popular, especially among children, to wear athletic shoes. This popularity has spurred the growth of a substantial industry supplying such shoes. While athletic shoes have been designed for specific activities such as basketball, tennis, running, walking etc., other users choose a shoe for fashion. Some of the important considerations for such consumers are: brand name, materials and fabrics used, color, and ornamentation. Ornamental design has become an increasingly important factor in the popularity of an athletic shoe as can be seen by the variety of designs which have been on the increase over the years.

Consumers of these products have encountered problems which have not been effectively addressed heretofore. Firstly, when the uppers get dirty and stained, there is no effective means of cleaning them thoroughly and efficiently. If athletic shoes are put into the washer and dryer, the longevity of the shoe is significantly decreased.

Secondly, the price of athletic shoes has risen considerably over the years. If one wants to buy a new design, one must buy a whole new shoe rather than buying uppers separately which in effect would be more economical.

Thirdly, owning several pair of shoes is cumbersome and requires a relatively large amount of storage space.

Finally, frequently when the shoes are used in strenuous athletic endeavors, the soles may wear out before the uppers. It would be beneficial to facilitate replacement of such worn out soles. Alternatively, due to technical advances in the area of materials for soles increasing the longevity of use thereof, users, who wear athletic shoes for less strenuous leisure activities, find their uppers wear out before the soles thereby increasing the need to be able to change the upper.

Heretofore, attempts have been made to design athletic shoes having a detachable outersole or the entire sole itself for the purpose of using one upper on a variety of soles; each sole being designed for a different activity. However, the prior art has not found an acceptable method of attaching a new sole and heel to a lightweight athletic shoe. Not only has the prior art not found an acceptable attachment means enabling the sole and upper to be detached, the prior art has missed a major market in the athletic shoe industry---consumers who purchase shoes for fashion and ornamentation.

It has been previously proposed in U.S. Pat. No. 4,745,693 to provide a slide fastener or zipper for use in attaching the upper and sole of footwear. However, there are several disadvantages to using a zipper as at attachment means for shoes. The structural integrity of the zipper for securing the upper to the sole is specious at best. Since athletic shoes absorb considerable amounts of stress and shock when used, zippers have a tendency to burst open when put under significant stress. Additionally, the teeth of the zipper can be damaged in a variety of ways rendering it useless. Since athletic shoes take a considerable amount of abuse and stress under normal wear, these factors raise serious questions with regard to the durability of the teeth and strength of the zipper as a whole.

Additionally, even though most zippers have a built-in lock, when bumped, they can tend to slip from the locked position and open, compromising the attachment means. Zippers on shoes are especially susceptible to this hazard. Although U.S. Pat. No. 4,745,693 shows a keeper strap devised to protect the pull tab of the zipper from unlocking, this strap detracts from the ornamental design of the shoe. In addition, the zipper itself overemphasizes the attachment means and detracts from the ornamental design of the shoe. Furthermore, the zippers are generally not water resistant and liquid passes through them easily. While a zipper provides an easy means of attachment, when considering the amount of shock and stress encountered by an athletic shoe, the durability and the security of this fastening means is clearly suspect.

It is an object of the present invention to provide a novel attachment device for engagement between the upper and sole of an article of footwear.

It is also an object to provide such an attachment device which allows the article of footwear to be cleaned and washed easily and thoroughly by hand or machine without weakening the structure of the shoe significantly.

Another object is to provide an attractive attachment device which allows an economical means of purchasing a variety of ornamental upper designs and colors, all readily removable or interchangeable.

Yet another object is to provide such an attachment device which will not slip open when hit thereby eliminating the need for additional security straps or devices to prevent the attachment from opening.

Still another object is to provide such an attachment device which is water resistant and is a means of maximizing the use of the sole of the shoe.

A further object is to provide such an attachment device which may be readily and economically fabricated and which exhibits a long life in service.

Still further objects and advantages will become apparent from consideration of the ensuing description and drawings.

SUMMARY OF THE INVENTION

It has now been found that the foregoing and related objects can be readily attained in a shoe assembly comprising, in combination, a lower shoe portion, an upper shoe portion and an attachment device allowing the upper and lower shoe portions to be easily attached to and detached from one another during use of the shoe assembly.

The lower shoe portion is adapted to cover a lower portion of the foot of the wearer and includes an elongated sole, a heel at one end of said sole and a curved toe at the opposite end thereof. The lower shoe portion has an elongated upper edge portion extending around the heel starting at a point located adjacent to the toe on one side of the lower shoe portion and ending at a point located adjacent to the toe on the opposite side of the lower shoe portion. The upper shoe portion is adapted to cover an upper portion of the wearer's foot and has an elongated lower edge portion the length of which is substantially equal to the length of the upper edge portion. The upper shoe portion is of a size and shape such that it defines an elongated opening extending substantially between the toe and the heel for receiving the foot of the wearer.

Ideally, the attachment device comprises a first engaging member affixed to and extending continuously along the length of the lower edge portion and a second engaging member affixed to and extending continuously along the length of the upper edge portion. The first and second members engaging one another continuously along the respective lengths thereof to provide a positive connection between the upper and lower shoe portions.

In the preferred embodiment, one of the first and second engaging members comprises a female channel track and the other of the first and second engaging members comprises a male bead track. The male bead track extends continuously through the female channel track. The male bead track and the female channel track can both be made from a plastic resin material.

In another embodiment, the female channel track is affixed to the upper edge portion and the male bead track is affixed to the lower edge portion. The male bead track is a loop of fabric material surrounding a central plastic core.

As an optional feature, the upper shoe portion has releasable eyelet units thereon. The upper shoe portion has a pair of opposed elongated inclined edge portions, each with an eyelet unit attachment thereon and an eyelet unit releasably engaged with the eyelet unit attachment. Each eyelet unit attachment includes a track dimensionally sized to retain a mating track on its corresponding eyelet unit.

The invention will be fully understood when reference is made to the following detailed description taken in conjunction with the accompanying drawings.

DETAILED DESCRIPTION OF THE PREFERRED EMBODIMENTS

Figure 1:
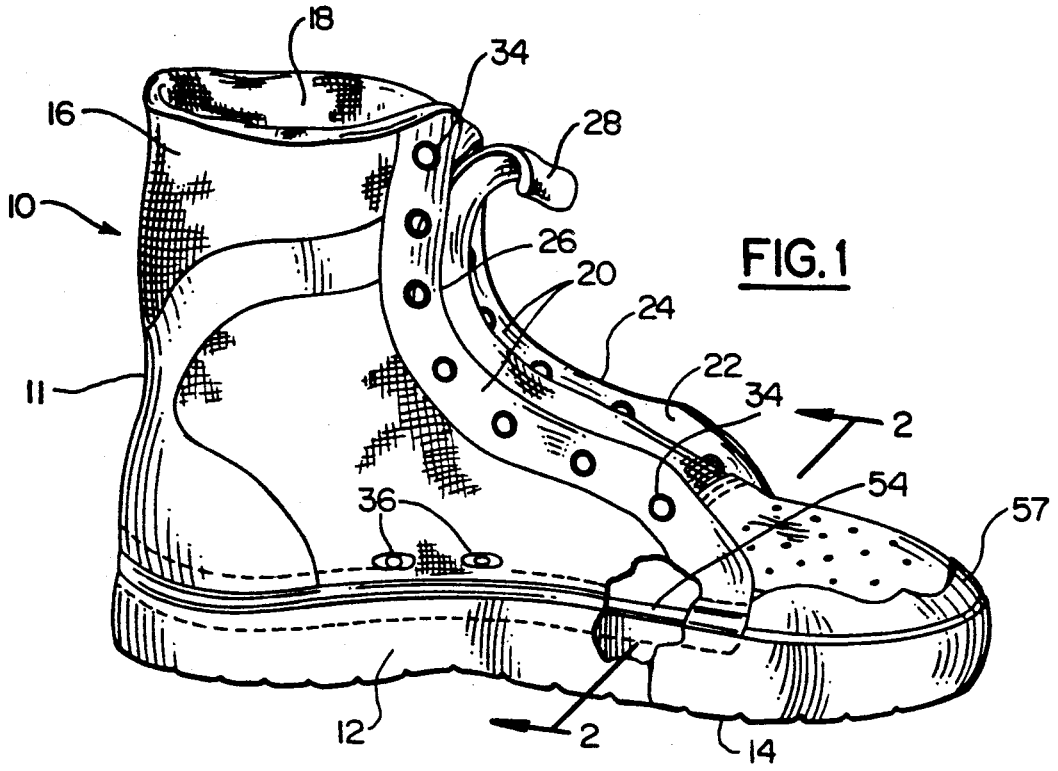
FIG. 1 is a perspective view of an athletic shoe having removable uppers through use of an attachment device embodying the present invention, portions of the shoe are broken away to illustrate the underlying securing structure.

Turning first to FIG. 1 of the drawings, therein is illustrated a canvas hightop athletic shoe embodying the present invention and generally designated by the numeral 10. The shoe 10 is provided with appropriate design features 11. The shoe 10 has an elongated sole-and-toe portion 12, at least a portion of which is made from rubber or other high friction material with a tread 14 of appropriate design. Releasably secured to the sole-and-toe portion 12 is an upper portion 16, generally constructed from a canvas fabric material, to define an enclosure or interior 18. The upper 16 has a pair of opposed flaps 20 defining a throat or opening 22 between the opposed edges 24 and 26 thereof. A tongue 28 underlies the flaps 20 within the throat 22 and is releasably attached at its lower end to the sole-and-toe portion 12 by means of mating hook-and-loop fastening devices 30 and 32 (see FIG. 3).

The shoe 10 has a multiplicity of pairs of opposed eyelets or apertures 34 in the upper 16 which are reinforced by metallic grommets and are spaced uniformly along the opposed reinforced edges 24 and 26 of the flaps 20 adjacent the throat 22. In normal use, a lace (not shown) extends through the eyelets 34 in the flaps 20 in an interlacing or crisscrossing manner. This arrangement allows the user to draw together the opposed edges 24 and 26 of the flaps 20 by pulling on the free ends of lace. Two side vents 36 permit the flow of air to and from the interior 18 of the shoe 10.

Figure 2:
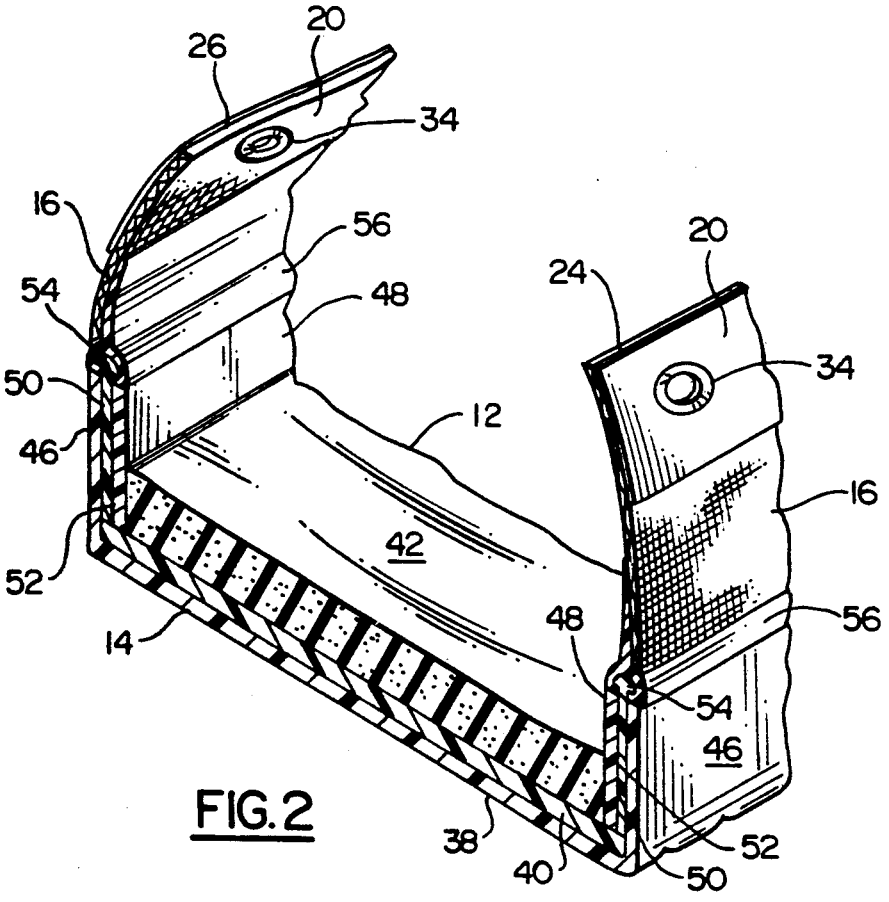
FIG. 2 is a cross-sectional perspective view of the shoe assembly of the present invention taken along the 2—2 line of FIG. 1.

As seen in FIG. 2, the sole-and-toe portion 12 is an assembly of various parts including an outersole 38 having the previously mentioned tread design 14 thereon. Secured to the outersole 38 by adhesive, stitching or other suitable means are an overlying innersole 40 with appropriate padding 42. The innersole 40 can be a fabric or vinyl material while the padding 42 can be molded sponge rubber designed to absorb shocks. A sole wall assembly extends around the exterior of the outersole 38 and is provided by an exterior wall portion 46 and a slightly smaller interior wall portion 48. Sandwiched between and extending above the exterior wall portion 46 and interior wall portion 48 is a male track portion 50. The male track portion 50 has a male track flange 52 secured between the exterior wall portion 46 and interior wall portion 48 and also has a male track bead 54 at its upper end. The male track bead 54 has a mushroom shaped cross-section (FIG. 2) and extends at least partially around an upper edge of the sole-and-toe portion 12 terminating at terminal ends 55 adjacent and outboard of either side of the toe 57 (FIG. 3).

Slidably received on the male track bead 54 is a channel track 56 of the upper portion 16. The channel track 56 has an opening dimensionally sized to accept the mushroom shaped cross-section of the male track bead 54 in a tightly sealed waterproof mating relationship. The channel track 56 is secured to the upper portion 16 by means of adhesive, stitching or other suitable means. The surface of the channel track 56 is designed to be flush with the interior wall portion 48 so as to create a smooth transition line therebetween to prevent irritation which might be caused by the rubbing of an uneven surface against the foot of the wearer.

Figure 3:
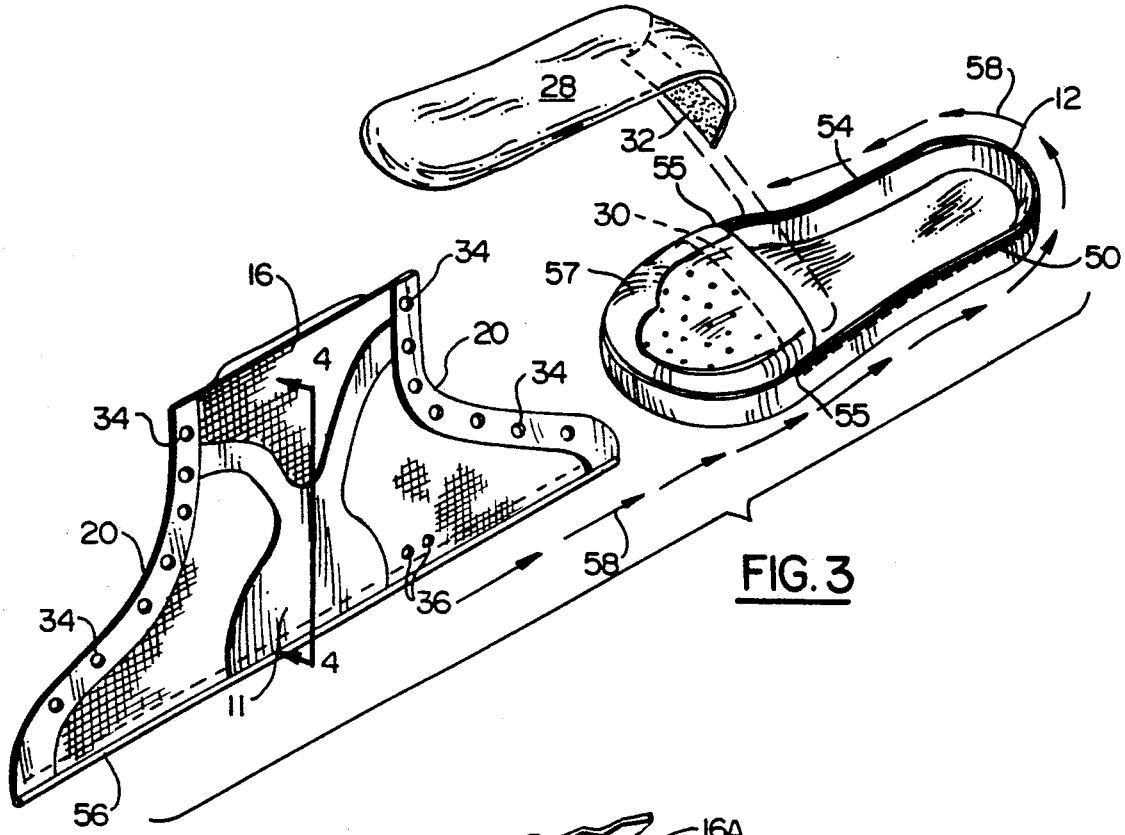
FIG. 3 is a perspective view of the shoe assembly of FIG. 1 showing the method of assembling the same.

Referring to FIG. 3, to attach the upper portion 16 to the sole-and-toe portion 12, the upper portion 16 is slid thereon as indicated by arrows 58 until the ends of the channel track 56 meet the terminal ends 55 of the male track portion 50 forming a secure and attractive attachment of the upper portion 16 to the sole-and-toe portion 12. In this manner, the design features 11 are properly located on the exterior of the shoe 10. Alternatively, another design or color can be provided on the side of the upper portion 16 opposite the design features 11 so as to be visible if the upper portion 16 is assembled to the sole-and-toe portion 12 with the alternative design o the exterior of shoe 10.

If desired, one end of the channel track 56 can be closed so as to abut against its corresponding terminal end 55 of the male track portion 50 thereby properly aligning the upper portion 16 and sole-and-toe portion 12. If releasability between the upper portion 16 and sole-and-toe portion 12 is not needed or desired, it is possible to permanently attach the two components by providing adhesive or some other suitable permanent attachment means between the male track portion 50 and channel track 56.

It should be appreciated by those skilled in the art that the male track portion 50 and channel track 56 can be formed by extrusion or injection molding processes from suitable synthetic plastic resin such as polyurethane, polyethylene, polyvinylchloride or vinyl. In addition, the exact shape of male track portion 50 and channel track 56 can take various suitable forms.

Figures 4, 6, 7, 8:
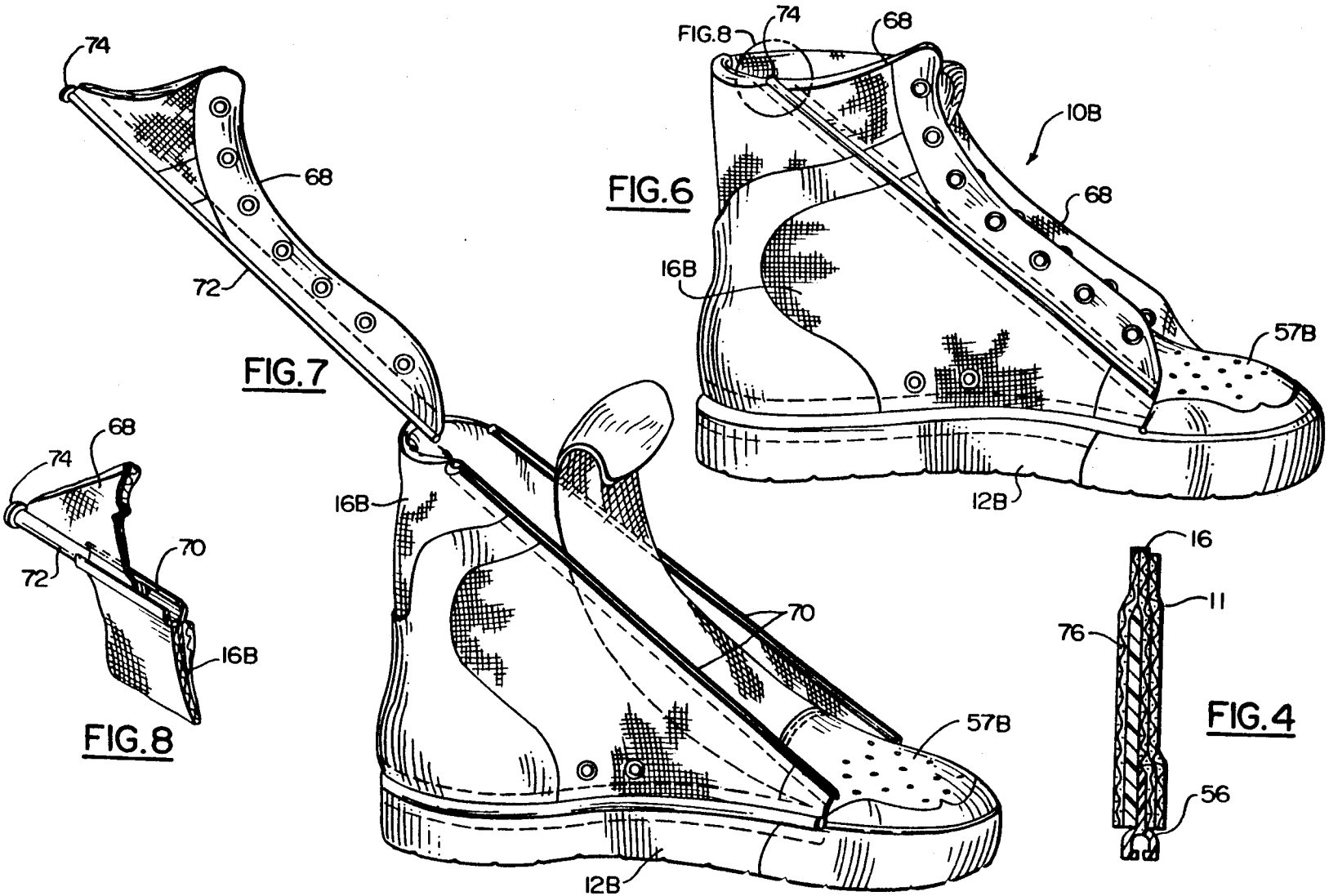
FIG. 4 is a cross-sectional view of the heel area of the uppers showing the stiffening member therein taken along the 4—4 line of FIG. 3.
FIG. 6 is a perspective view of an optional feature of the attachment device of the present invention having the lace portions of the uppers removable.
FIG. 7 is a perspective view of the shoe assembly of FIG. 6 showing the lace portions of the uppers removed; an FIG. 8 is an enlarged fragmentary perspective view illustrating the interconnection between the lace and main portions of shoe assembly of FIG. 6.

FIG. 4 shows a cross-section of the upper portion 12 of FIG. 1. A rubber heel support 76 is shown sewn, glued or otherwise secured therein to provide suitable structural integrity to the heel portion of the shoe 10.

Figure 5:
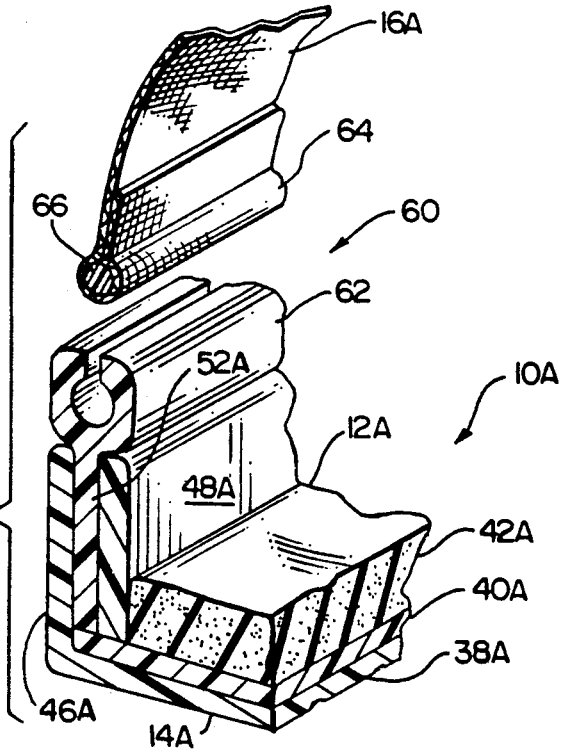
FIG. 5 is a fragmentary cross-sectional perspective view of a second embodiment of the attachment device of the present invention.

Turning now to FIG. 5, therein is illustrated a second embodiment of the shoe generally indicated by the numeral 10A. The parts similar to those in the first embodiment are designated by like numerals except for the addition of the letter A. This embodiment has an upper portion 16A and a sole-and-toe portion 12A with tread 14A on outersole 38A. An innersole 40A is secured to the outersole 38A and is provided with appropriate padding 42A. A flange 52A is secured between an exterior wall portion 46A and interior wall portion 48A. The difference between the first and second embodiment is the attachment device generally indicated by the numeral 60 which is provided by a channel member 62 on the flange 52A dimensionally sized to accept a loop 64 of fabric surrounding a central core member 66 on the upper 16A. The central core member 66 can be made from a suitable synthetic plastic resin secured within the loop 64 by adhesive, stitching or the like. To assemble the upper portion 16A to the sole-and-toe portion 12A, the loop 64 and central core member 66 are threaded into the channel member 62 in a manner similar to the first embodiment as shown in FIG. 3.

Shown in FIGS. 6–8 is an optional feature where an upper portion 16B of a shoe 10B includes a pair of washable eyelet units 68 secured by mating tracks 70 and 72. A male track 72 is attached to a lower portion of each of the eyelet units 68 while channel tracks 70 are attached to the upper portion 16B at an inclined angle. The tracks 70 and 72 can be extruded synthetic plastic resin material fastened to their respective upper portion 16B or releasable eyelet units 68 by adhesives, stitching or the like. The male track 72 of each releasable eyelet unit 68 extends the entire length of the outside edge of the eyelet units 68. The channel tracks 70 run along the top of sloped edge of upper portion 16B. In this embodiment, the sole-and-toe portion 12B is releasably attached to the upper portion 16B in a manner identical to the FIG. 1 embodiment.

The male tracks 72 each have a stopper bead 74 at the upper ends thereof. If the wearer experiences slippage toward toe 57B, beginning of eyelet unit 68 can be threaded through top of channel track 70 until stopper bead 74 meets the top of channel track 70 thereby preventing downward slippage. If direction of slippage is away from toe 57B then beginning of male track 72 of eyelet unit 68 can be threaded through the bottom of channel track 70 until stopper bead 74 meets the bottom of channel track 70 preventing upward slippage. While the above describes a particular attachment means for the eyelet units 68, button, snaps, zippers and the like may also be used.

Thus, it can be seen from the foregoing detailed specification and attached drawings that the shoe of the present invention with its detachable upper provides an easy and convenient method for allowing the wearer greater flexibility and versatility regarding color and design. The upper can be purchased separately from the sole at a cheaper cost than purchasing a whole new shoe. Therefore, the invention provides an economical means of owning a variety of colors and ornamental upper designs. The invention enables wearer to thoroughly clean shoe by machine washing and drying the upper without weakening the structure of the shoe.

Furthermore, the shoe of the present invention with its detachable upper has additional advantages in that it:

provides a variety of shoe designs while maximizing storage space;

provides a means of maximizing use of the sole of the shoe;

provides an attachment means which is superior in durability to the zipper;

provides an attachment means which will not open when hit while being worn;

provides an attachment means which eliminates the need for additional security straps or devices to prevent attachment means from opening;

provides an attachment means which is symmetric and esthetically appealing thereby not detracting from the ornamental design of the shoe;

provides an attachment means which is both flexible and can be brightly colored; and provides an attachment means which is water resistant.

Although the description above contains many specificities, these should not be construed as limiting the scope of the invention but merely providing illustrations of the invention, it will be appreciated that many modifications and changes may be made by those skilled in the art without departing from the spirit of the invention. For example, the channel track and male track can have a variety of shapes, such trapezoidal, triangular, circular, etc. The tracks can extend the entire circumference of both the upper and the sole whereby a partial section of the make track separates from the sole forming an end piece which allows the channel track to be threaded over the male track forming a secure attachment of the sole and upper. In addition to the hook-and-loop material as shown, the tongue can be made detachable by a track design, zippers or the like. The tongue can be provided with overlays which may be attached by a variety of means. Alternatively, detachable ankles support using the track design can be provided thereby permitting hightops to be converted into lowtops, as well as color and design changes, etc. Finally, the lace combined with the cooperating pairs of opposed apertures do not necessarily have to be used with the shoes and can be replaced by hook-and-loop material for fastening the shoe to the foot of the wearer.

Thus, the scope of the invention should be determined by the appended claims and their legal equivalents, rather than by example given.

What is claimed is:

1. A shoe assembly comprising, in combination:

a lower shoe portion adapted to cover a lower portion of the foot of the wearer, said lower shoe portion including an elongated sole, a heel at one end of said sole and a curved toe at the opposite end thereof and having an elongated upper edge portion extending around said heel starting at a point located adjacent to said toe on one side of said lower shoe portion and ending at a point located adjacent to said toe on the opposite side of said lower shoe portion;

an upper shoe portion adapted to cover an upper portion of the wearer's foot, said upper shoe portion having an elongated lower edge portion the length of which is substantially equal to the length of said upper edge portion, said upper shoe portion being of a size and shape such that it defines an elongated opening extending substantially between said toe and said heel for receiving the foot of said wearer; and means for releasable connecting said lower edge portion to said upper edge portion so as to leave an open throat between said starting and ending points whereby said upper and lower shoe portions can be easily attached to and detached from one another during use of said shoe assembly.

2. The shoe assembly according to claim 1, wherein said releasable connecting means comprises a first engaging member affixed to and extending continuously along the length of said lower edge portion and a second engaging member affixed to and extending continuously along the length of said upper edge portion, said first and second members engaging one another continuously along the respective lengths thereof to provide a positive connection between said upper and said lower shoe portions.

3. The shoe assembly according to claim 2, wherein one of said first and second engaging members comprises a female channel track and the other of said first and second engaging members comprises a male bead track, said male bead track extending continuously through said female channel track.

4. The shoe assembly according to claim 3, wherein said female channel track is affixed to said lower edge portion and said male bead track is affixed to said upper edge portion.

5. The shoe assembly according to claim 3, wherein said female channel track is affixed to said upper edge portion and said male bead track is affixed to said lower edge portion.

6. The shoe assembly according to claim 5, wherein said male bead track is a loop of fabric material surrounding a central core.

7. The shoe assembly according to claim 3, wherein said male bead track and said female track are made from a plastic resin material.

8. The shoe assembly according to claim 1, wherein said upper shoe portion has releasable eyelet units thereon.

9. The shoe assembly according to claim 1, wherein said upper shoe portion has a pair of opposed elongated inclined edge portions, each with an eyelet unit attachment thereon and an eyelet unit releasably engaged with said eyelet unit attachment.

10. The shoe assembly according to claim 9, wherein each said eyelet unit attachment includes track means dimensionally sized to retain mating track means on its corresponding eyelet unit.

11. The shoe assembly according to claim 1, wherein said upper shoe portion has first and second decorative sides which can be alternatively placed so as to be visible from the exterior of said shoe assembly through use of said releasable connecting means.

12. A shoe assembly comprising, in combination:

a lower shoe portion adapted to cover a lower portion of the foot of the wearer, said lower shoe portion including an elongated sole, a heel at one end of said sole and a curved toe at the opposite end thereof and having an elongated upper edge portion extending around said heel starting at a point located adjacent to said toe on one side of said lower shoe portion and ending at a point located adjacent to said toe on the opposite side of said lower shoe portion;

an upper shoe portion adapted to cover an upper portion of the wearer's foot, said upper shoe portion having an elongated lower edge portion the length of which is substantially equal to the length of said upper edge portion, said upper shoe portion being of a size and shape such that it defines an elongated opening extending substantially between said toe and said heel for receiving the foot of said wearer; and a first engaging member affixed to and extending continuously along the length of said lower edge portion and a second engaging member affixed to and extending continuously along the length of said upper edge portion so as to leave an open throat between said starting and ending points, said first and second members engaging one another continuously along the respective lengths thereof to provide a positive connection between said upper and said lower shoe portions.

13. The shoe assembly according to claim 12, wherein one of said first and second engaging members comprises a female channel track and the other of said first and second engaging members comprises a male bead track, said male bead track extending continuously through said female channel track.

14. The shoe assembly according to claim 13, wherein said female channel track is affixed to said lower edge portion and said male bead track is affixed to said upper edge portion.

15. The shoe assembly according to claim 13, wherein said female channel track is affixed to said upper edge portion and said male bead track is affixed to said lower edge portion.

16. The shoe assembly according to claim 15, wherein said male bead track is a loop of fabric material surrounding a central core.

17. The shoe assembly according to claim 13, wherein said male bead track and said female track are made from a plastic resin material.

18. The shoe assembly according to claim 12, wherein said upper shoe portion has releasable eyelet units thereon.

19. The shoe assembly according to claim 12, wherein said upper shoe portion has a pair of opposed elongated inclined edge portions, each with an eyelet unit attachment thereon and an eyelet unit releasably engaged with said eyelet unit attachment.

20. The shoe assembly according to claim 19, wherein each said eyelet unit attachment includes track means dimensionally sized to retain mating track means on its corresponding eyelet unit.

21. A shoe assembly comprising, in combination:

a lower shoe portion adapted to cover a lower portion of the foot of the wearer, said lower shoe portion including an elongated sole, a heel at one end of said sole and a curved toe at the opposite end thereof, said curved toe forming an enclosure for a portion of the foot of the wearer, said lower shoe portion having an elongated upper edge portion extending around said heel starting at a point located adjacent to said toe outboard thereof on one side of said lower shoe portion and ending at a point located adjacent to said toe outboard thereof on the opposite side of said lower shoe portion;

an upper shoe portion adapted to cover an upper portion of the wearer's foot, said upper shoe portion having an elongated lower edge portion the length of which is substantially equal to the length of said upper edge portion, said upper shoe portion being of a size and shape such that it defines an elongated opening extending substantially between said toe and said heel for receiving the foot of said wearer; and means for releasable connecting said lower edge portion to said upper edge portion whereby said upper and lower shoe portions can be easily attached to and detached from one another during use of said shoe assembly from the point located adjacent to said toe outboard thereof on one side of said lower shoe portion and ending at the point located adjacent to said toe outboard thereof on the opposite side of said lower shoe portion without engaging said curved toe.

22. A shoe assembly comprising, in combination:

a lower shoe portion adapted to cover a lower portion of the foot of the wearer, said lower shoe portion including an elongated sole, a heel at one end of said sole and a curved toe at the opposite end thereof, said curved toe forming an enclosure for a portion of the foot of the wearer, said lower shoe portion having an elongated upper edge portion extending around said heel starting at a point located adjacent to said toe outboard thereof on one side of said lower shoe portion and ending at a point located adjacent to said toe outboard thereof on the opposite side of said lower shoe portion;

an upper shoe portion adapted to cover an upper portion of the wearer's foot, said upper shoe portion having an elongated lower edge portion the length of which is substantially equal to the length of said upper edge portion, said upper shoe portion being of a size and shape such that it defines an elongated opening extending substantially between said toe and said heel for receiving the foot of said wearer; and a first engaging member affixed to and extending continuously along the length of said lower edge portion and a second engaging member affixed to and extending continuously along the length of said upper edge portion, said first and second members engaging one another continuously along the respective lengths thereof to provide a positive connection between said upper and said lower shoe portions from the point located adjacent to said toe outboard thereof on one side of said lower shoe portion and ending at the point located adjacent to said toe outboard thereof on the opposite side of said lower shoe portion without engaging said curved toe.

* * * * *